US006368062B1

(12) United States Patent
Yagami et al.

(10) Patent No.: US 6,368,062 B1
(45) Date of Patent: Apr. 9, 2002

(54) TURBO FAN FOR RANGE HOOD AND RANGE HOOD STORING TURBO FAN

(75) Inventors: Mototake Yagami; Kiyohiko Sato, both of Kanagawa-ken (JP)

(73) Assignee: Fuji Industrial Co., Ltd., Tokyo (JP)

( * ) Notice: Subject to any disclaimer, the term of this patent is extended or adjusted under 35 U.S.C. 154(b) by 0 days.

(21) Appl. No.: 09/613,719

(22) Filed: Jul. 11, 2000

(30) Foreign Application Priority Data

Jun. 6, 2000 (JP) ..... 2000-169275

(51) Int. Cl.[7] ..... F04D 29/38

(52) U.S. Cl. ..... 416/178; 416/187; 416/214 R; 416/232; 416/DIG. 3

(58) Field of Search ..... 416/214 R, 232, 416/178, 187, DIG. 3; 72/379.2

(56) References Cited

U.S. PATENT DOCUMENTS

| | | | | | |
|---|---|---|---|---|---|
| 2,772,851 | A | * | 12/1956 | Stalker | 416/214 R |
| 2,923,462 | A | * | 2/1960 | Stalker | 416/214 R |
| 3,144,204 | A | * | 8/1964 | Bohanon | 416/178 |
| 3,857,270 | A | * | 12/1974 | Iten | 72/324 |
| 6,156,090 | A | * | 12/2000 | Ishikawa et al. | 55/471 |

* cited by examiner

*Primary Examiner*—Edward K. Look
*Assistant Examiner*—Ninh Nguyen
(74) *Attorney, Agent, or Firm*—Greenblum & Bernstein P.L.C.

(57) ABSTRACT

The spring-back state of the blade press formed from the metallic thin plate is restricted to form the blade of wing sectional shape strictly in accordance with the design. The blade is formed into the wing sectional shape having a hollow inner part with both sides fixed to the upper plate and the lower plate being released under application of the press forming of the metallic thin plate. The blade is made such that the metallic thin plate (a) having a rectangular shape as seen from its top plan view with one side being a wing width (W) size is applied with a coining work, a number of linear deformation segments in parallel with the side of the wing width (W) size are properly spaced apart along a side crossing at right angle with the side of the wing width (W) size in side-by-side relation, the direction crossing at a right angle with the side of the wing width (W) size of the metallic thin plate (a) is formed into the curved surface of predetermined curvature and then a transfer of the recovering force generated at each of the belt-like plates between the linear deformation segments is shut off at the linear deformation segments so as to restrict influence against the entire metallic thin plate (a).

8 Claims, 7 Drawing Sheets

TURBO FAN FOR RANGE HOOD AND RANGE HOOD STORING TURBO FAN

BACKGROUND OF THE INVENTION

1. Field of the Invention

This invention relates to a turbo fan for a range hood and a range hood storing the turbo fan therein.

2. Description of the Related Art

In the conventional system of a turbo fan, the turbo fan is constituted such that the fan is installed in a flat type range hood and the blades are properly spaced apart along a circumferential direction between an upper plate and a lower plate and fixed there.

The blade was made such that after a metallic thin plate such as a galvanized iron plate or an aluminum plate was punched out of a base material and machined, the plate was bent and machined to have a curved surface with a predetermined curvature.

Although this kind of blade was less-expensive in view of its cost, it showed a tendency that a certain eddy flow was produced at the surface of the blade due to an air peeling from a cutting end edge (a front edge) acting as a wind shearing section to have a high noise value.

In order to solve this problem, there has been proposed to provide a turbo fan made of synthetic resin in which a vane wheel is of a resin-molded product and the blade has a wing section.

However, due to the fact that the turbo fan was relatively large in its diameter, it required a certain rigidity and accuracy in size, this prior art turbo fan had some problems that not only a cost of die and material expenditure were increased, but also the turbo fan could not be used in a country where its regulation in fire-prevention required that materials other than metal should not be used.

SUMMARY OF THE INVENTION

The present invention has been invented in view of the aforesaid circumstances in the prior art and its technical problem consists in forming a metallic blade for restricting noise to a low value.

Another technical problem consists in restricting a spring-back state of a blade pressed and machined from a metallic thin plate and forming such a blade as one having a wing sectional shape strictly in accordance with its design.

A gist of the technical means for solving the aforesaid object consists in the arrangement in which the blade is formed to have a wing sectional shape having hollow inner side where the sides of the metallic thin plate fixed to the upper plate and the lower plate through press formation of the metallic thin plate are released.

This technical means contributes to prevention of occurrence of eddy flow caused by peeling-off of air due to shape characteristic of the blade having a wing sectional shape and contributes to a reduction in noise value of the turbo fan showing a higher noise sound as compared with that of a sirocco fan.

Although this blade is not restricted to its number of one metallic thin plate or a plurality of metallic thin plates, it is preferable that the blade is composed of one metallic thin plate in view of its manufacturing cost.

In addition, the blade is more preferable if the blade is formed by applying a coining work to a metallic thin plate having a rectangular shape as seen from its top plan view with one side being of a wing width (W) size, arranging a large number of linear deformed segments in parallel with the side having the wing width (W) size in proper side-by-side spaced apart relation along a side crossing at a right angle with the side of the wing width (W) size, forming the direction crossing at a right angle with the side of the wing width (W) size of the metallic thin plate into a curved surface having a predetermined curvature and then bending the metallic thin plate in a semi-bent state in parallel with the side of the wing width (W) size.

The linear deformed segment is continuously formed or intermittently formed along an entire length of the wing width (W) size of the blade.

Although the coining work was used as a press machining method in which a machined item such as a metallic plate and the like was stored in a closed die, the item was compressed and the corrugations or protrusions having the same shape as those of the upper die and the lower die were pressed against the front surface and the rear surface of the item, the metallic thin plate having a direction crossing at a right angle with the side of the wing width (W) size formed into a curved surface of predetermined curvature through a coining work was restricted in its spring-back characteristic as compared with the case in which a plate was simply bent into a curved surface of predetermined curvature. A mechanism for restricting the spring-back characteristic is realized by an arrangement in which a coining work is applied to a metallic thin plate having a rectangular shape as seen from its top plan view with one side being of a wing width (w) size and a large number of linear deformed segments in parallel with the side having the wing width (W) size are arranged in proper side-by-side spaced apart relation along a side crossing at a right angle with the side of the wing width (W) size, each of the belt-like plates is shielded or cut at the linear deformed segments, a recovering force generated at each of the belt-like plates after coining work is separated and accommodated at each of the linear deformed segments and the force is not transferred to the entire metallic thin plate.

Due to this fact, it becomes possible to form the blade having a wing sectional shape of inner hollow part with a desired design size.

In addition, the linear deformed segment includes a formation made at either an outer surface or inner surface only of the blade, or at both outer surface and inner surface, respectively.

However, in the case that the linear deformed segment is realized only at the inner surface of the blade, the linear deformed segment does not become a resistance against air, but effective in view of its aerodynamic state. In addition, in order to prevent the recovering force of each of the belt-like plates between the linear deformed segments from influencing against the entire metallic thin plate as much as possible, it is preferable that the linear deformed segments are formed continuously over the entire length of the wing width (W) size.

DESCRIPTION OF THE PREFERRED EMBODIMENTS

Figure 1:
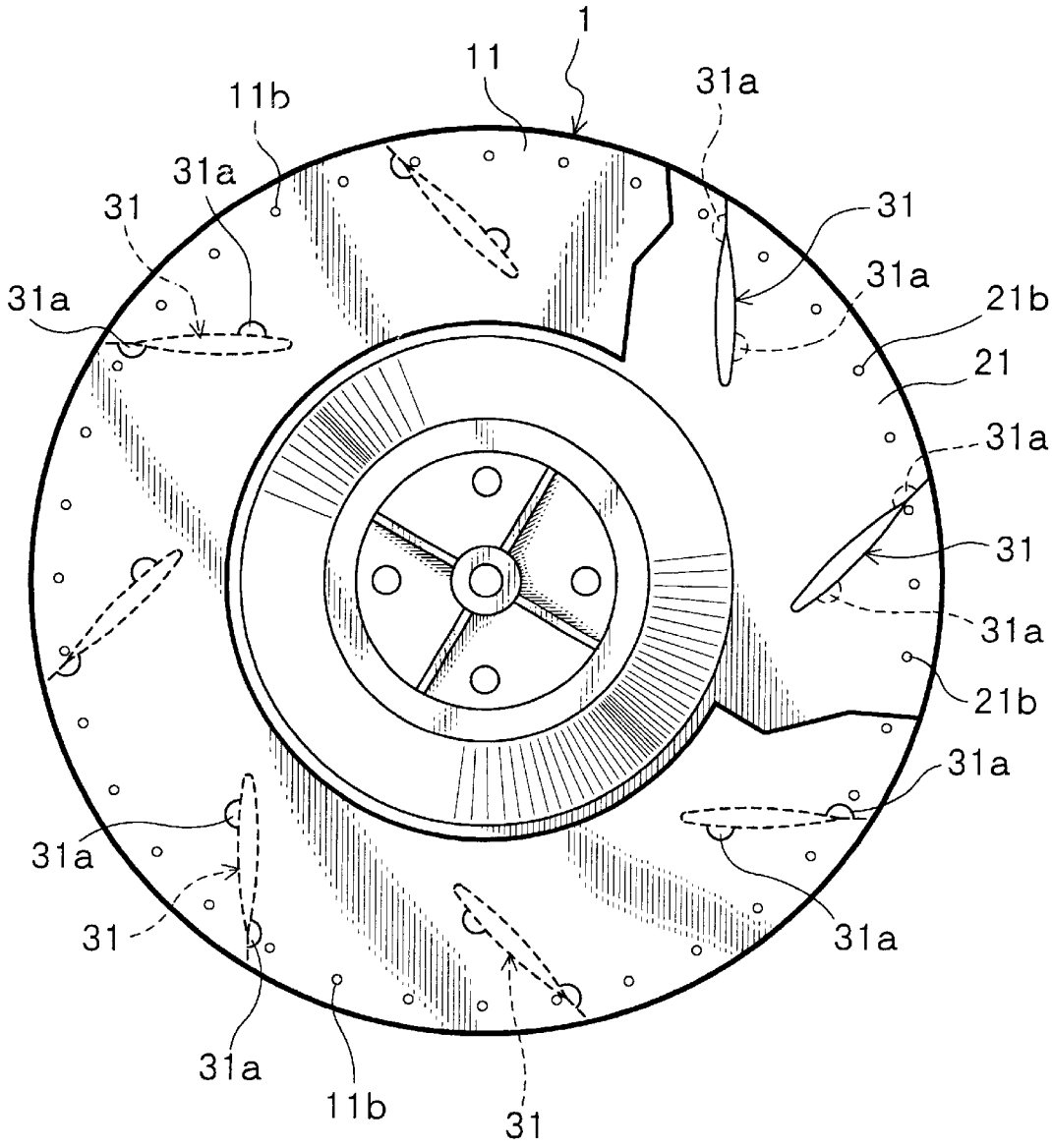
FIG. 1 is a front elevational view with a part being broken away.

Referring now to the drawings, some preferred embodiments of the present invention will be described as follows.

Figure 5:
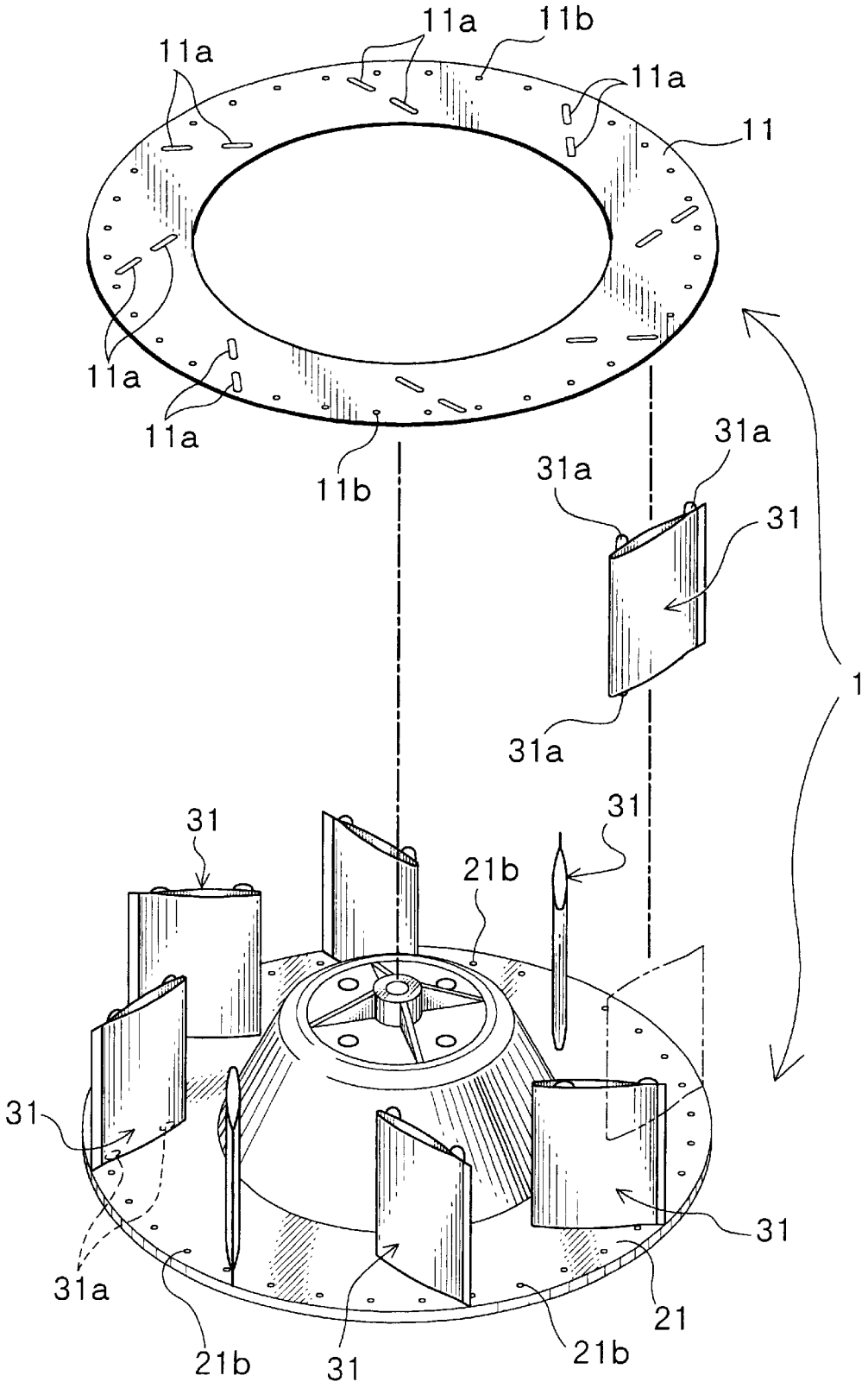
FIG. 5 is an exploded perspective view for showing an assembled state of a turbo fan.
Figure 6:
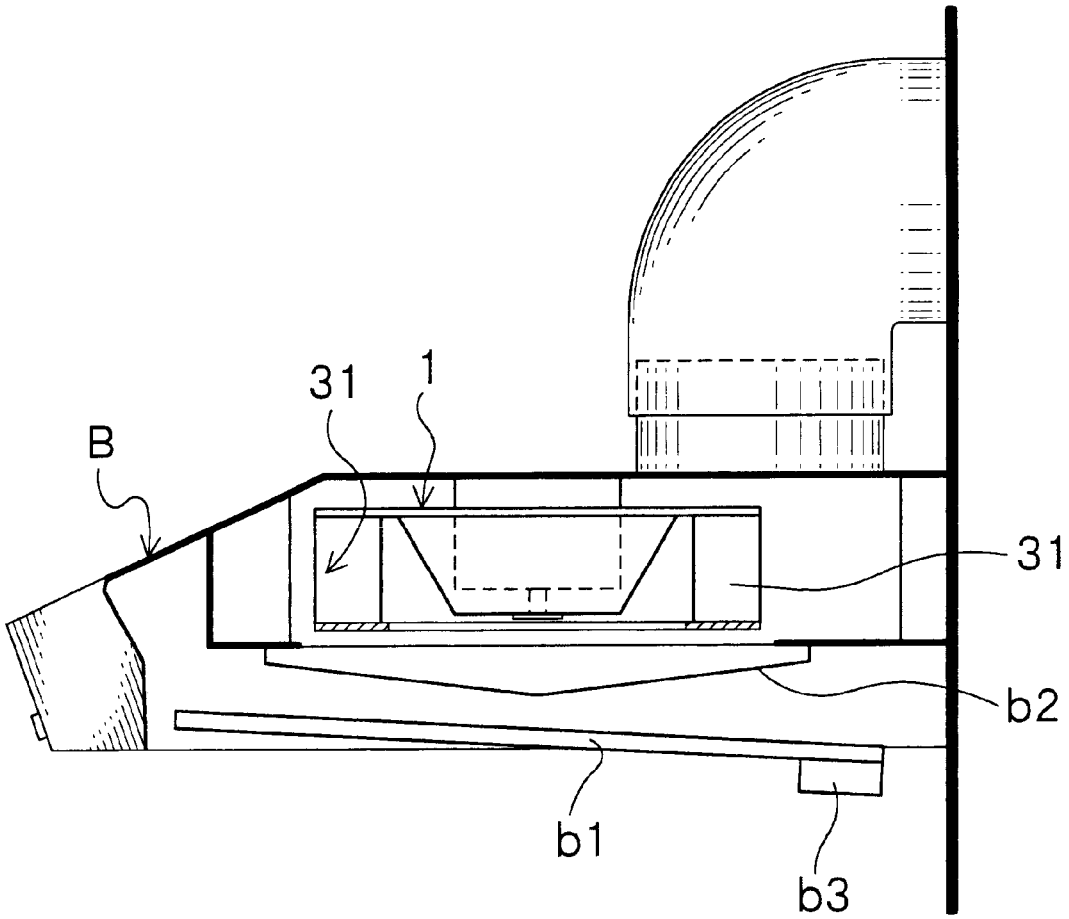
FIG. 6 is a side elevational view for showing a state of using a turbo fan with a part being broken away.
Figure 7:
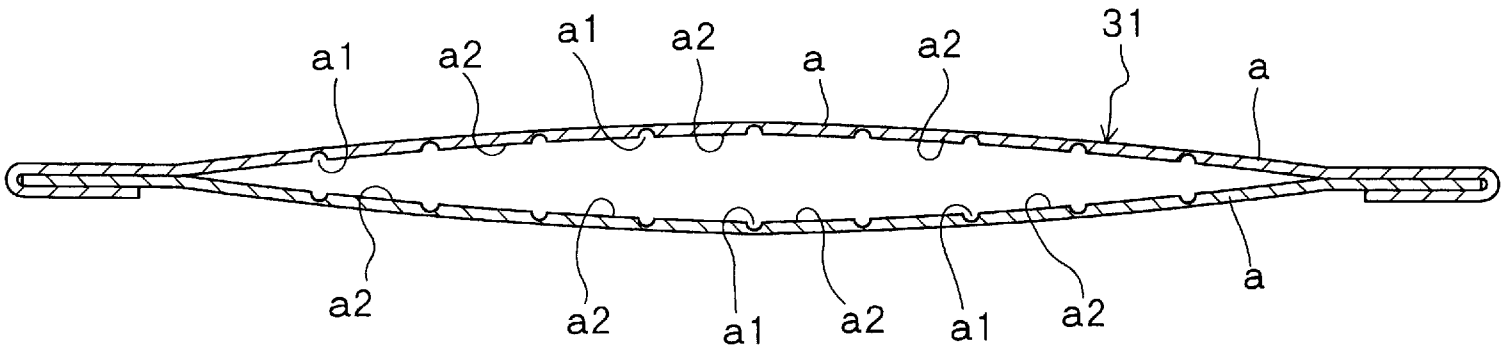
FIG. 7 is an enlarged sectional view for showing another preferred embodiment of the present invention.

FIGS. 1 to 6 illustrate a first preferred embodiment of the present invention and FIG. 7 illustrates a second preferred embodiment of the present invention, respectively. At first, the first preferred embodiment will be described.

The turbo fan 1 is of a well-known type in which a plurality of blades 31 are spaced apart along a circumferential direction between an upper plate 11 and a lower plate 21, and as the blades 31 the members formed into a wing sectional shape having inner hollow part with both sides fixed to the upper plate 11 and the lower plate 21 under application of a press forming of a metallic thin plate (a) being released are used.

Figure 2:
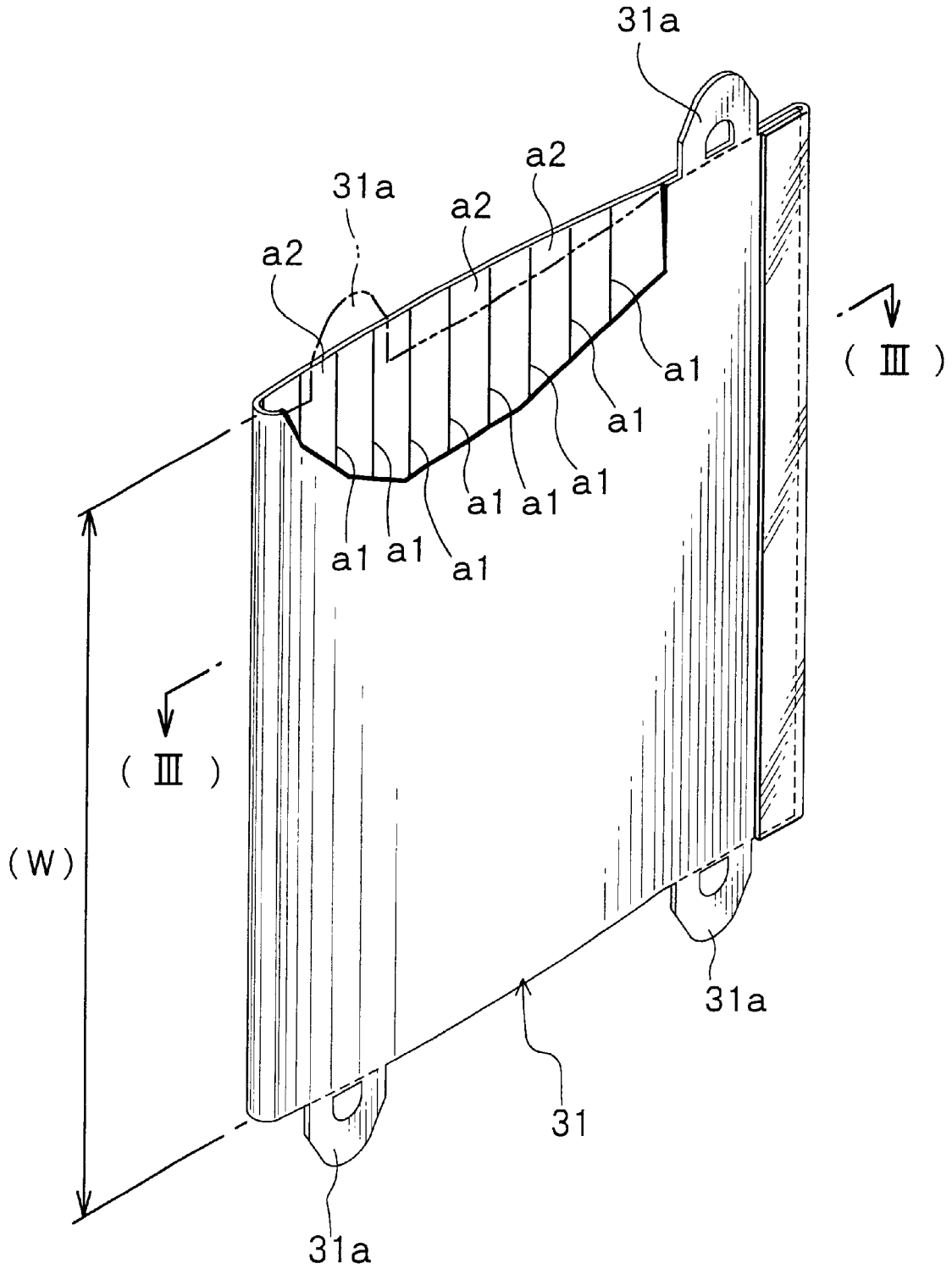
FIG. 2 is a perspective view for showing a blade with a part being broken away.
Figure 3:
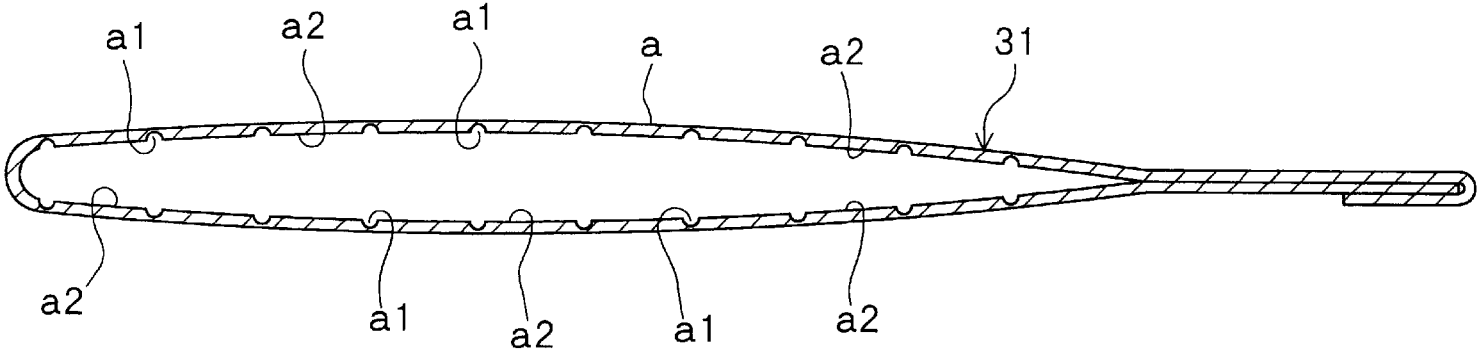
FIG. 3 is an enlarged sectional view taken along line (III)—(III) of FIG. 2.
Figure 4:
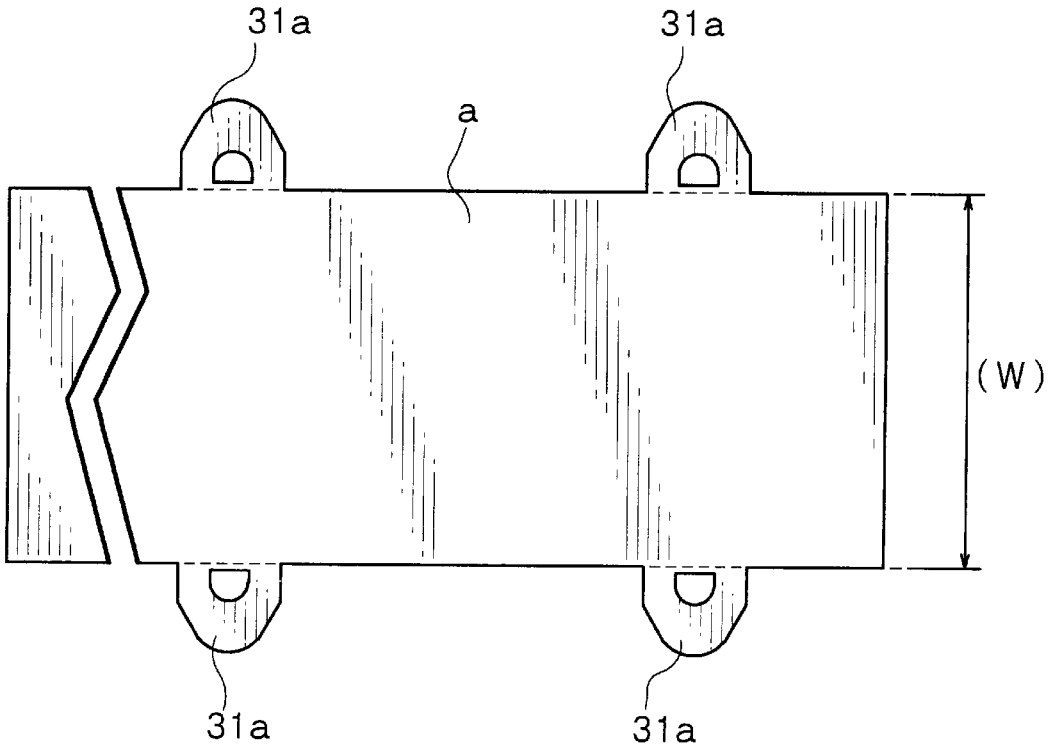
FIG. 4 is a developed view for showing a metallic thin plate used for forming a blade with a part being eliminated.

The blades 31 are formed of a sheet of metallic thin plate (a) under application of press work, wherein FIG. 2 shows a perspective view of the blade, FIG. 3 shows a cross-sectional view of the blade, and FIG. 4 shows a developed blade in which a base material is punched and worked, i.e. the metallic thin plate (a).

The blades 31 have a plurality of engaging claws 31*a*, 31*a* (two claws in this preferred embodiment) spaced apart at both longitudinal edges, wherein the rectangular-shaped metallic thin plate (a) with a short size being applied as a wing width (W) size is punched out as shown in FIG. 4, a coining work is applied to the substantial entire surface of the metallic thin plate (a), a direction crossing at a right angle with a side of the wing width (W) size, i.e. the longitudinal direction of it is bent to a predetermined curvature, thereafter the metallic thin plate (a) is bent in a half-state from a substantial central part in the longitudinal direction to cause both short side edges to be abutted against to each other, both free ends are fastened and fixed to form the wing sectional shape having a hollow inner part with both ends of the wing width (W) direction (sides fixed to the upper plate and the lower plate) being released as shown in FIG. 2.

Both free ends are not fastened and fixed, but they may be freely fixed by another fixing means such as a spot welding and the like.

The coining work is carried out in the preferred embodiment such that an upper die and a lower die are used in such a way that a number of linear deformed segments (indentations) a1 in parallel with a side of the wing width (W) size are arranged side-by-side only at the inner surface of the blade 31 of inner hollow state along a side crossing at a right angle with the side of the wing width (W) size and realized (exposed).

In the case of the metallic thin plate (a) in which the longitudinal direction is bent to a curved surface having a predetermined curvature under application of the coining work, a transfer of the recovering force of each of the belt-like plates 12 between the linear deformations a1, a1 is divided and accommodated at the linear deformations a1, a1, resulting in that the spring-back after work is restricted.

Shape of each of the aforesaid upper die and lower die is not described in detail. Curvature of the compressed surface, shape of the protrusion forming the linear deformed segment as well as its pitch, height and compressing force or the like are set in reference to thickness and material quality of the base material, i.e. the metallic thin plate (a) and a curvature of the curved surface formed by the coining work and the like.

The blades 31 in which after coining work, the plate is bent into a half-bent state as shown in FIGS. 2 and 3, the free end portions are fixed to form a wing sectional shape having a hollow inner part are set such that the front edge faces toward the upstream side as shown in FIG. 5, each of the engaging claws 31*a*, 31*a* described above is protruded outwardly from the engaging holes 11*a*, 21*a* opened in correspondence with the same positions of the upper plate 11 and the lower plate 21, thereafter each of both engaging claws 31*a*, 31*a* is bent in an opposite direction and fastened and they are equally spaced apart along the circumferential directions of the upper plate 11 and the lower plate 21 and fixed to assemble and form the turbo fan 1.

In FIGS. 1 and 5, reference numerals 11*b*, 21*b* denote fixing holes for use in fixing a balance ring and the holes are equally spaced apart and opened on the same circumference of the upper plate 11 and the lower plate 21.

Then, as shown in FIG. 6, this turbo fan 1 is installed within a flat type range hood B. Reference numeral b1 denotes a flow regulating plate for increasing a suction flow speed of air around the circumference at the lower surface of the hood and also increasing a discharged gas collecting efficiency; reference numeral b2 denotes a slot filter arranged between the flow regulating plate b1 and a bell-mouth, wherein oil collected with the slot filter b2 is stored in an oil pack b3 arranged at the lower location of the flow regulating plate b1 with the rear surface of the flow regulating plate b1 being applied as a flow passage.

Then, the second preferred embodiment shown in FIG. 7 will be described as follows, wherein this preferred embodiment shows a blade 31 of wing sectional shape in which the two metallic thin plates (a), (a) are applied and press formed into this shape.

In the case of this preferred embodiment, each of the two metallic thin plates (a), (a) is formed into a curved surface of predetermined curvature through a coining work in the same manner as that of the aforesaid first preferred embodiment, then they are fastened and fixed in such a way that the end part of the other metallic thin plate (a) is held by one end part of one metallic thin plate (a), or the end part of one metallic thin plate (a) is bent along the end part of the other metallic thin plate (a), the bent part is spot welded against the mating plate to form the blade 31 having a wing sectional shape of designed size to be targeted by the two metallic thin plates (a), (a). Further, both front and rear free end portions are not limited to their fastening or fixing and spot welding, but it is optional to perform the fixing operation by another fixing means.

Although not illustrated, the aforesaid engaging claw 31*a* is protruded from any one of the metallic thin plates (a), or the claw is protruded from both metallic thin plates (a), (a).

As to the arrangement in which a number of linear deformations (indentations) a1 are properly spaced apart in parallel with the side of the wing width (W) size and along a side crossing at a right angle with the side of the wing width (w) size, this arrangement is the same as that described in the aforesaid preferred embodiment.

In addition, the present invention is not limited to the symmetrical wing described in the first and second preferred embodiments, but includes a non-symmetrical wing.

Although the forming stage for the non-symmetrical wing is not described in detail, the blade is formed by a method wherein the plate is applied with the coining work at a predetermined curved surface having a different curvature at one half segment and the other segment with the substantial central part of the metallic thin plate being interfaced, or the coining work with a different curvature curved in an opposite direction is applied to the one half segment and the other half segment, thereafter, the blade is processed with the half-bending work, fastening at the free ends or spot welding for them as described above.

It is of course apparent that the blades of the turbo fan of the present invention are formed under an individual wing sectional shape in reference to each of the specifications in compliance with a diameter size and the number of rotation or the like.

EXAMPLES

Each of the turbo fan of the aforesaid first preferred embodiment (using eight blades) and the prior art turbo fan (using eight metallic single blades) was manufactured to have an inner diameter size of 190 mm and an outer diameter size of 275 mm with a maximum air volume of 510 $m^3/h$ and their noise values were measured to show that the prior art product showed 56.9 dB and the present invention showed 55.9 dB decreased by 1 dB.

The turbo fan had a higher sound level than that of the sirocco fan and the reduction of noise by 1 dB at this higher sound level showed a substantial practical difference, which could be discriminated by hearing organs.

EFFECTS OF THE INVENTION

As described above, the blades in the present invention are formed into a wing sectional surface shape having a hollow inner part with both side of the metallic thin plate fixed to the upper plate and the lower plate under application of the press formation of the metallic thin plate being released, so that it is possible to provide a turbo fan under a less-expensive cost in which noise can be restricted low, its twisting strength and bending strength are high and its durability is substantially improved.

Further, it has been found that the blade is made such that the metallic thin plate having a rectangular shape as seen from its top plan view with one side being a wing width (W) size is applied with a coining work, a large number of linear deformation segments in parallel with the side of the wing width (W) size are properly spaced apart along a side crossing at right angle with the side of the wing width (W) size in side-by-side relation, the direction crossing at a right angle with the side of the wing width (W) size of the metallic thin plate is formed into the curved surface of predetermined curvature and then a transfer of the recovering force generated at each of the belt-like plates between the linear deformation segments is shut off at the linear deformation segments formed by the coining work and does not influence against the entire metallic thin plate and the spring-back action is restricted, so that it is possible to provide a turbo fan in which it becomes possible to form the blade of wing sectional shape having a theoretical design size with one metallic thin plate under a certain reformation, the material cost is decreased and a superior fluid characteristic is attained.

In addition, in the case of the system in which the aforesaid linear deformation segments are realized only at the inner surface of the blade, it may contribute to arrangement of the turbo fan having a more superior fluid characteristic.

Having described specific preferred embodiments of the invention with reference to the accompanying drawings, it will be appreciated that the present invention is not limited to those precise embodiments, and that various changes and modifications can be effected therein by one of ordinary skill in the art without departing from the scope of the invention as defined by the appended claims.

What is claimed is:

1. A turbo fan for a range hood comprising:

an upper plate;

a lower plate;

at least one blade located between said upper plate and said lower plate, said at least one blade having one end affixed to said upper plate, and another end affixed to said lower plate, and a wing width direction extending between and substantially orthogonal to said upper plate and said lower plate, a plurality of linear deformation segments; wherein:

said at least one blade has a substantially wing-shaped cross-section and further has a hollow inner portion, said at least one blade press-formed from a metallic plate;

said metallic plate has a substantially rectangular shape, with one side thereof applied with a coining work corresponding to the wing width direction, thereby forming said plurality of linear deformation segments;

said plurality of linear deformation segments are located on said one side of said metallic thin plate and extend along a direction substantially orthogonal to the wing width direction;

each linear deformation segment of said plurality of linear deformation segments is substantially parallel to the wing width direction;

each said linear deformation segment is spaced apart from each other; and wherein said metallic thin plate is substantially folded in half to form a curved surface extending in a direction substantially parallel to the wing width direction.

2. The range hood having the turbo fan described in claim 1.

3. The turbo fan for a range hood as claimed in claim 1, wherein said linear deformation segments are located only on said inner portion.

4. The range hood having the turbo fan described in claim 3.

5. A turbo fan for a range hood comprising:

an upper plate;

a lower plate;

a plurality of blades located between said upper plate and said lower plate and about an axis of rotation, each blade of said plurality of blades having one end affixed to said upper plate, and another end affixed to said lower plate, and a wing width direction extending between and substantially orthogonal to said upper plate and said lower plate, each said blade comprising a pair of metallic plates;

a plurality of linear deformation segments; wherein:

each blade of said plurality of blades has a substantially wing-shaped cross-section and further has a hollow inner portion;

each said metallic plate of said pair of metallic plates has a substantially rectangular shape, with one side thereof applied with a coining work corresponding to the wing width direction, thereby forming said plurality of linear deformation segments;

said plurality of linear deformation segments are located on said one side of said metallic thin plate and extend along a direction substantially orthogonal to the wing width direction;

one edge of one metallic plate of said pair of metallic plates is fixed to one edge of the other metallic plate of said pair of metallic plates, both said edges substantially parallel to the wing width direction.

6. The range hood having the turbo fan described in claim 5.

7. The turbo fan for a range hood as claimed in claim 5, wherein said linear deformation segments are located only on said inner portion.

8. The range hood having the turbo fan described in claim 7.

* * * * *